US006688107B2

(12) United States Patent
Ono et al.

(10) Patent No.: US 6,688,107 B2
(45) Date of Patent: Feb. 10, 2004

(54) GAS TURBINE COMBUSTION DEVICE

(75) Inventors: Masaki Ono, Takasago (JP); Masaharu Nishimura, Takasago (JP); Keizo Ohnishi, Takasago (JP); Kazufumi Ikeda, Takasago (JP); Katsunori Tanaka, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 24 days.

(21) Appl. No.: 10/023,897

(22) Filed: Dec. 21, 2001

(65) Prior Publication Data

US 2002/0078676 A1 Jun. 27, 2002

(30) Foreign Application Priority Data

Dec. 26, 2000 (JP) ..... 2000-394858

(51) Int. Cl.[7] ..... F02C 7/24
(52) U.S. Cl. ..... 60/725
(58) Field of Search ..... 60/39.37, 725; 431/114

(56) References Cited

U.S. PATENT DOCUMENTS 4,122,674 A 10/1978 Andersson et al.
4,199,936 A 4/1980 Cowan et al.
4,409,787 A 10/1983 Davi et al.
4,719,748 A * 1/1988 Davis et al. ..... 60/39.37
5,186,620 A * 2/1993 Hollingshead ..... 431/354
5,644,918 A 7/1997 Gulati et al.

FOREIGN PATENT DOCUMENTS

| | | |
|---|---|---|
| EP | 0 892 216 | 1/1999 |
| EP | 0 962 699 | 12/1999 |
| EP | 1 213 539 | 6/2002 |
| GB | 2 309 296 | 7/1997 |
| JP | 09236261 A | 9/1997 |
| WO | WO 02/25174 | 3/2002 |

* cited by examiner

*Primary Examiner*—Ehud Gartenberg
(74) *Attorney, Agent, or Firm*—Oblon, Spivak, McClelland, Maier & Neustadt, P.C.

(57) ABSTRACT

A gas turbine combustion device comprises a plurality of combustion devices. Each combustion device has an inner cylinder and a tail cylinder in a vehicle chamber. An acoustic sleeve is provided between each inner cylinder and a corresponding outer cylinder in the vehicle chamber. An acoustic coupling effect with a vehicle chamber can be reduced.

6 Claims, 8 Drawing Sheets

<experiment in a real machine>

<experiment in one element> mND in an inner peripheral direction in a vehicle chamber

GAS TURBINE COMBUSTION DEVICE

The entire disclosure of Japanese Patent Application No. 2000-394858 filed on Dec. 26, 2000 including specification, claims, drawings and summary is incorporated herein by reference in its entirety.

BACKGROUND OF THE INVENTION

The present invention relates to a gas turbine combustion device. More specifically, the present invention relates to a method for reducing combustion oscillation in view of an acoustic problem, particularly to a method for reducing acoustic resonance.

FIG. 8 shows a conventional gas turbine combustion device.

In a conventional gas turbine combustion device as shown in FIG. 8, exhaust air from a compressor flows into a vehicle chamber 1 and further into a turbine through a combustion device 4 having an inner cylinder 2 and a tail cylinder 3.

FIG. 2*a* and 2*b* show a simplified gas turbine combustion device wherein a plurality of cylinder combustion devices 4 are arranged along a circular peripheral line. Each cylinder combustion device has an inner cylinder 2 and a tail cylinder 3. Thus, the vehicle chamber 1 and the combustion device 4 are acoustically connected.

As described above, in the conventional art, the vehicle chamber 1 and the combustion device 4 are acoustically connected in a system, wherein the combustion device 4 has a number of acoustic modes connected to a circular peripheral mode in the vehicle chamber 1 so that combustion oscillation occurs in any one of the modes.

When experimental combustion occurs in a sector (c) of one combustion device as shown in FIG. 2*a*, reproduced combustion oscillation is different from that in an actual vehicle chamber mode. Accurate reproduction in the actual vehicle chamber mode is difficult.

For example, as shown in FIG. 3*a*, there is shown an m-order nodal diaphragm (mND). If an n-order acoustic mode exists in the combustion device 4, the number of oscillations is m×n.

That is, the combustion device mode is related to the vehicle body mode. In the case that the value m of the nodal diaphragm is changed, its acoustic character is largely changed even if the value n of the acoustic mode is acoustically connected.

As shown in the following equation, a stable characteristic Ec of combustion oscillation is determined based on an acoustic mode shape and acoustic frequency at the combustion position. On the other hand, the vehicle chamber is a sector in the element experiment so that a circular peripheral mode in the vehicle chamber is not formed and the acoustic characteristic is different from that in an actual case.

$$Ec=-\int\int p(x,t)q(x,t)dxdt=-\int\int p(x)\cos\omega tQ(x)\cos\{\omega(t+\tau)\}dxdt \quad (1)$$

Wherein, p, q, ω, τ0 and τ1 is pressure, energy output, angular frequency, combustion system time delay and a supply system time delay, respectively. The following equation also applies; $\tau=\tau0+\tau1$.

As shown in FIG. 7, damping energy Ef becomes stable where $Ec+Ef=E\tau>0$ and the damping energy Ef becomes unstable and, oscillation occurrs in the case of $Ec+EF=E\tau<0$. Q(x) and τ are only influenced by combustion elements and p(x) and ω are only influenced by acoustic elements.

Accordingly, in an oscillating model as shown in FIG. 9, the number of unstable regions are m (value of circular peripheral model) ×n (value of combustion device mode).

For example, if a nodal diaphragm order along the circular peripheral direction in a vehicle chamber 1 is 4, and a 3 order acoustic mode is present in the combustion device 4, twelve unstable regions (4×3) are present.

Accordingly, in the conventional gas turbine combustion device, combustion oscillation caused by thermal elements and acoustic elements is apt to happen so that the gas turbine combustion device is damaged.

SUMMARY OF THE INVENTION

To overcome the above problems, a gas turbine combustion device according a first aspect of the present invention comprises a plurality of combustion devices provided in a vehicle chamber in which each combustion device has an inner cylinder and a tail cylinder, and wherein each said gas turbine device has an acoustic sleeve between an outer cylinder and said inner cylinder.

A gas turbine combustion device according to a second aspect of the present invention comprises pores provided at a vehicle chamber side of the acoustic sleeve according to the first aspect of the present invention.

A gas turbine combustion device according to a third aspect of the present invention comprises a plurality of combustion devices provided in a vehicle chamber, in which each combustion device has an inner cylinder and a tail cylinder, a side wall having a porous structure is provided near an opening end of said combustion device at an upstream side.

In a gas turbine combustion device according to a fourth aspect of the present invention, a sintered metal mesh, a ceramic piece or a porous board is provided at an outer side of said porous board according to the third aspect of the present invention.

In a gas turbine combustion device according to a fifth embodiment of the present invention, a contraction in a flow path is provided near the opening portion according to the third aspect of the present invention.

In a gas turbine combustion device according to a sixth aspect of the present invention, a porous board is located at a position perpendicular to a combustion flow at an upstream side of the combustion device according to the third, fourth and fifth aspects of the present invention.

In a gas turbine combustion device according to a seventh aspect of the present invention, a board having a narrow slit instead of a side wall having a porous structure is provided near an opening portion of the combustion device at an upstream side according to the third, fourth, fifth and sixth aspects of the present invention.

DETAILED DESCRIPTION OF THE PREFERRED EMBODIMENT

Embodiment 1

Figure 1:
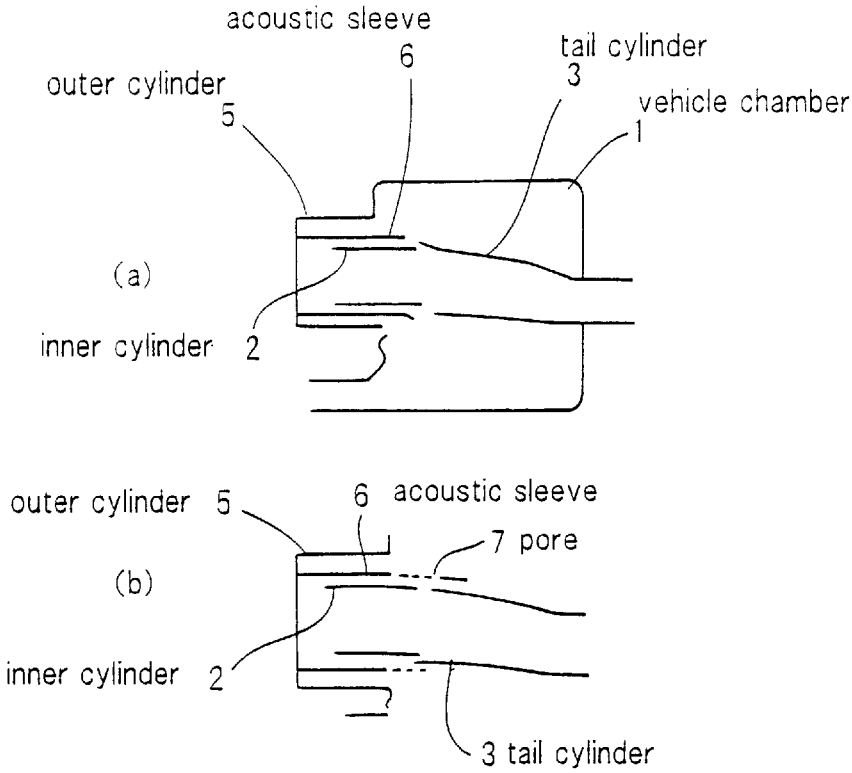
FIGS. 1(*a*) and 1(*b*) shows a general view of a gas turbine combustion device according to a first embodiment and a second embodiment of the present invention.
Figure 2A:
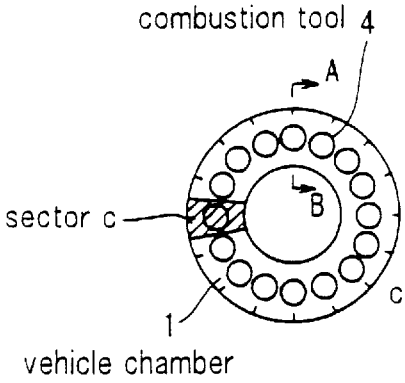
FIGS. 2*a* and 2*b* respectively shows a end and side views of a conventional gas turbine combustion device.
Figure 2B:
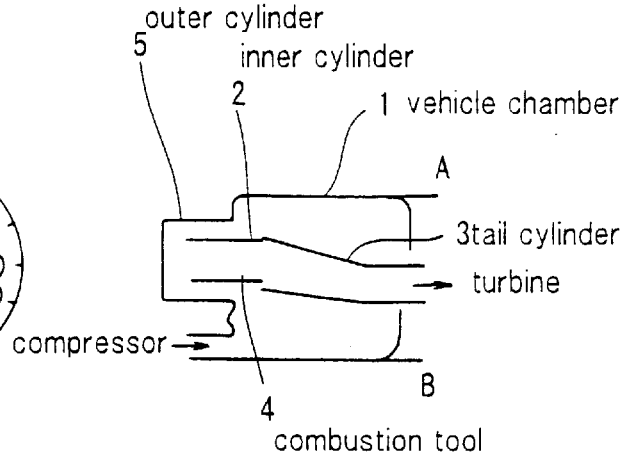
Figure 3A:
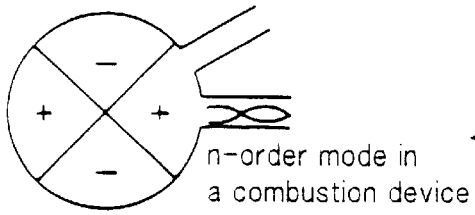
FIGS. 3*a* and 3*b* shows a conventional acoustic model in a relation between a combustion device and a vehicle chamber.
Figure 3B:
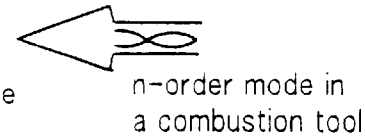

A first embodiment of a gas turbine combustion device according to the present invention is shown in FIG. 1(*a*).

The first embodiment relates to a method for reducing acoustic coupling between combustion devices in a vehicle chamber.

In a vehicle chamber (combustion housing) 1, a number of cylindrical combustion devices 4, in which each cylindrical combustion device 4 has an inner cylinder 2 and a tail cylinder 3, are arranged along a circular peripheral line and an acoustic sleeve 6 is provided between each inner cylinder 2 and a corresponding outer cylinder 5 in the vehicle chamber 1.

Figure 4A:
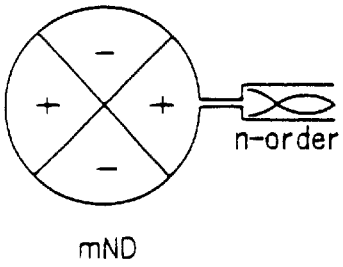
FIGS. 4*a* and 4*b* shows an acoustic model of the present invention in a relation between a combustion device and a vehicle chamber.

Thereby, as shown in FIG. 4*a*, the vehicle chamber 1 is acoustically connected to the combustion device 4 through a narrow path, that is, the acoustic sleeve 6.

Accordingly, an acoustic coupling effect formed by the vehicle chamber 1 and the combustion device 4 can be largely reduced. Even if an acoustic characteristic of the vehicle chamber 1 is changed, an acoustic characteristic of the combustion device 4 is not changed so much.

By reducing the coupling effect of the combustion device 4 and the vehicle chamber 1, a number of acoustic modes can be reduced. For example, an occurrence of oscillation can be reduced as shown a oscillation model in FIG. 10.

Figure 10:
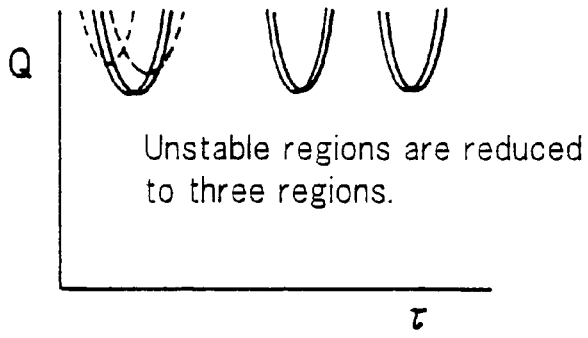
FIG. 10 is a graph showing an actuating condition according to the present invention.

FIG. 10 shows an example wherein a nodal diaphragm along a circular peripheral line in the vehicle chamber 1 is of fourth order and the third order acoustic mode exists in the combustion device 4. Even if the nodal diaphragm along the circular peripheral direction is changed, the number of unstable regions are about three since the acoustic characteristic of the combustion device 4 changes only a little. The longer the sleeve 6 becomes, the greater the effect becomes.

Figure 4B:
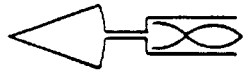

As shown in FIG. 4*b*, even if an element experiment is operated in a sector of the combustion device, a reproduced condition can be improved.

Although noise caused by flow might be increased by narrowing the flow path, the combustion device will not be damaged. Since the resonance is considered acceptable and self-oscillation can be prevented.

Embodiment 2

FIG. 1(*b*) shows a gas turbine combustion device of the second embodiment according to the present invention. The second embodiment employs a non-reflecting edge method. A number of cylindrical combustion devices 4 in which each combustion device 4 has an inner cylinder 2 and a tail cylinder 3 in a vehicle chamber are arranged along a circular peripheral line. An acoustic sleeve 6 is mounted between each inner cylinder 2 and the corresponding outer cylinder 5 in the vehicle chamber 1.

In addition, pores 7 are provided at a vehicle chamber end of the acoustic sleeve 6. Thus, the acoustic characteristic becomes similar to that at a non-reflecting end as seen from the combustion device 4 in the vehicle chamber 1. In addition to the reduction of the coupling effect with the vehicle chamber 1, an occurrence of standing waves is apt to be avoided.

In an ideal case, it is possible for a vehicle chamber end of the acoustic sleeve 6 to be a completely non-reflective end. In an actual case, a level of the acoustic character is low enough to ignore the coupling.

As described above, in the second embodiment according to the present invention, the coupling effect with the vehicle chamber can be reduced by providing a non-reflective end wherein pores are arranged at an end of the acoustic sleeve 6. In addition, the occurrence of the standing waves becomes reduced in the combustion device 4 so that the occurrence of combustion oscillation can be reduced.

Embodiment 3

Figure 5:
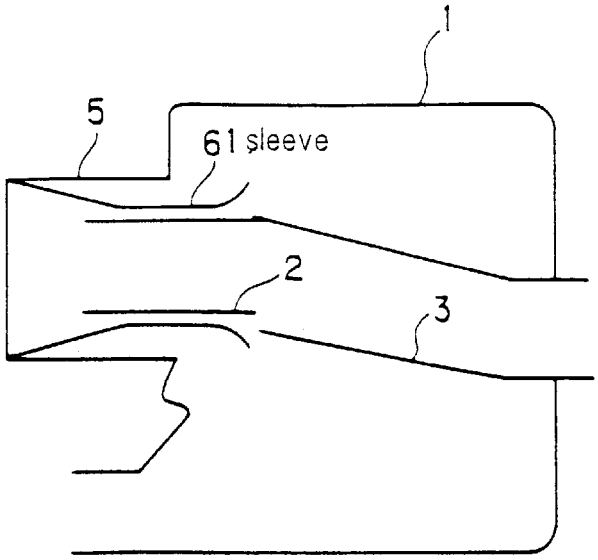
FIG. 5 shows a general view of a gas turbine combustion device of the third embodiment of the present invention.

FIG. 5 shows a third embodiment according to the present invention of a gas turbine combustion device.

The third embodiment relates to a type for reducing pressure loss.

The acoustic sleeve 6 described in the first embodiment may not have a straight shape. In the third embodiment, an acoustic sleeve 61 has a diffuser shape in order to reduce pressure loss.

In the third embodiment, the other components are arranged similar to the components of the first embodiment. The number of the acoustic modes can be reduced by reducing the coupling effect of the combustion device 4 and the vehicle chamber 1. Even if an element experiment is operated at one sector of the combustion device, an actual combustion oscillation can be reproduced in the first embodiment.

Embodiment 4

Figure 6:
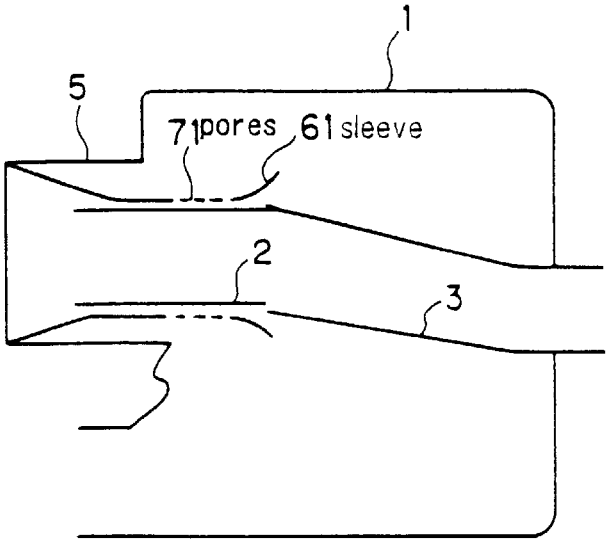
FIG. 6 shows a general view of a gas turbine combustion device of a fourth embodiment of the present invention.
Figure 7:
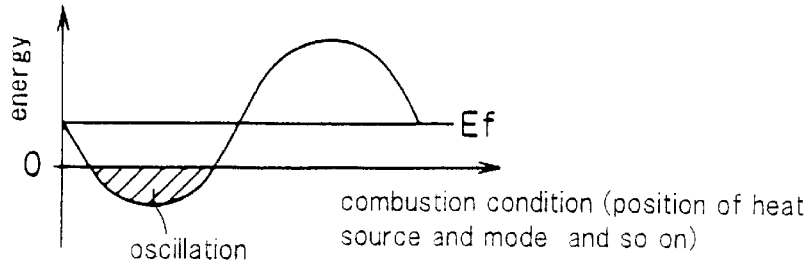
FIG. 7 is a graph showing a relation between energy and a combustion condition in a field.
Figure 8:
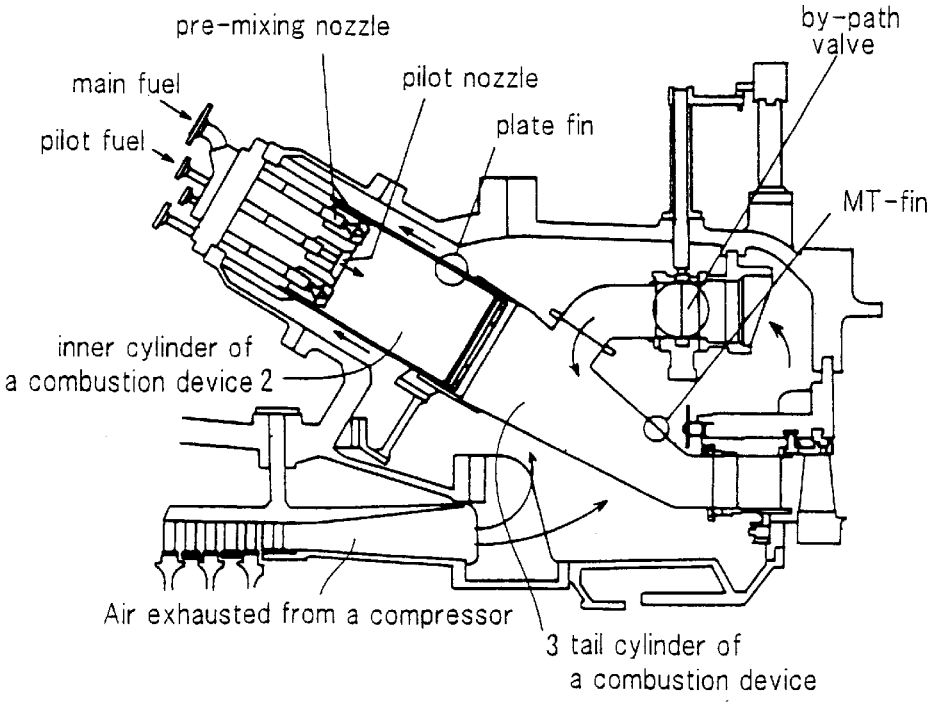
FIG. 8 shows a cross sectional view of a conventional gas turbine combustion device.
Figure 9:
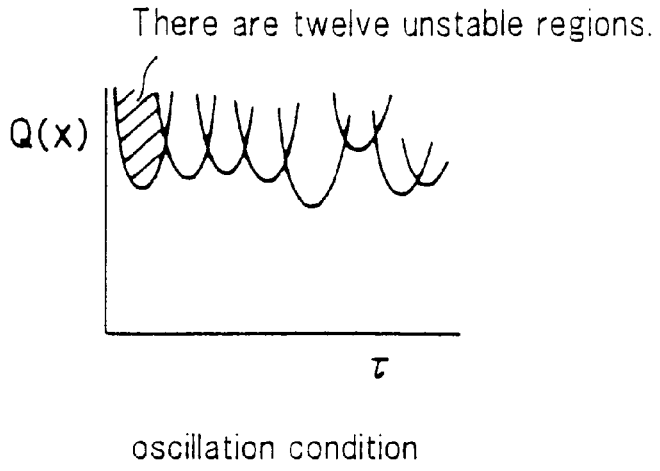
FIG. 9 is a graph showing a conventional actuating condition.

FIG. 6 shows a fourth embodiment according to the present invention of a gas turbine combustion device.

The fourth embodiment relates to a type for reducing pressure loss by combining the second embodiment and the third embodiment.

That is, a number of cylinder combustion devices, each combustion device 4 having an inner cylinder 2 and a rail cylinder 3 are arranged along an circular peripheral line in a vehicle chamber 1 and a diffuser acoustic sleeve 61 is provided at each inner cylinder 2 and the corresponding outer cylinder 5 in the vehicle chamber 1. Further pores 71 are properly provided at a vehicle chamber end of the acoustic sleeve 61.

In the fourth embodiment, an acoustic characteristic as seen from the combustion device 4 in the vehicle side 1 is similar to a characteristic at a non-reflect end so that an occurrence of standing waves is reduced in the combustion device 4. The pressure loss can be reduced in addition to the reduction of the coupling effect with the vehicle chamber 1. Effects of the second and third embodiments can be also obtained.

Embodiment 5

Figure 11:
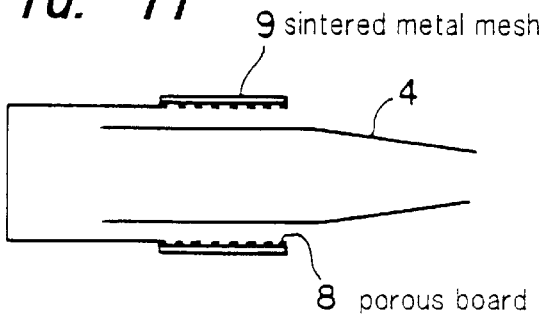
FIG. 11 shows a general view of a gas turbine combustion device of the fifth embodiment according to the present invention.

FIG. 11 shows a fifth embodiment of a gas turbine combustion device according to the present invention.

The fifth embodiment has a porous board 8 as a side wall near an opening portion at an upstream side of the combustion device 4.

Thereby, an acoustic reflective ratio at an opening portion can be reduced by controlling an impedance at the side wall so that the resonance in the combustion device can be reduced.

In the fifth embodiment, a sintered metal mesh 9 is added to an outer side surface of the porous board 8.

The sintered metal mesh 9 is provided so as to increase a resistance of the porous board 8 in the case that a resistance value of one porous board is insufficient.

In the above fifth embodiment, although the sintered mesh board 9 is provided, a ceramic piece, a porous board and so on may be provided.

In the fifth embodiment, the acoustic characteristic can be controlled at the opening portion of an intake port as seen from an interior side of the combustion device so that the variable pressure increases and self-oscillation caused by the resonance can be reduced.

In the fifth embodiment, a reflective ratio can be reduced at the opening portion by providing a side wall having a porous structure near the opening portion. The result is shown in FIG. 17.

Figure 17:
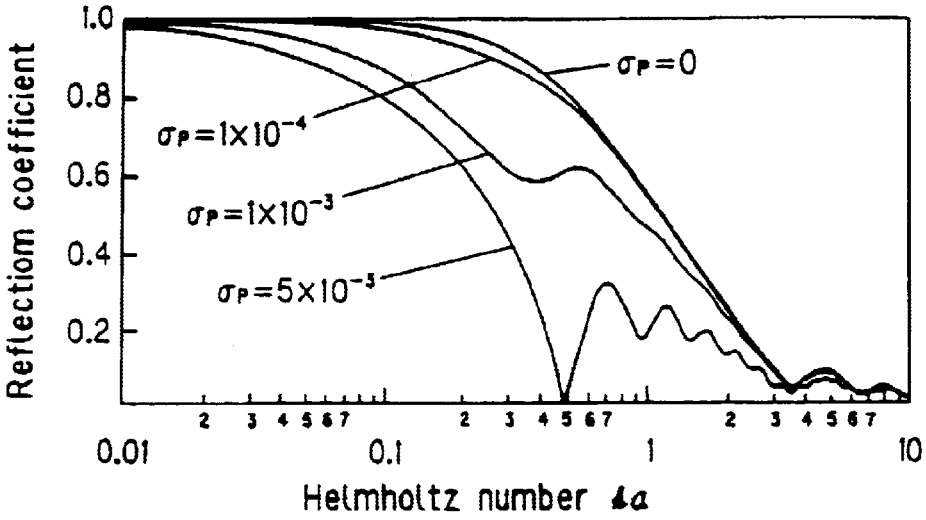
FIG. 17 shows a reflective ratio.

In FIG. 17, $\sigma p$, k and a indicates an open degree at a pore portion, wave number of an acoustic wave and a radius of the opening portion, respectively.

As shown in FIG. 17, a vertical axis shows the reflective ratio. It is an absolute value of a ratio of acoustic pressure amplitude of a reflective wave with respect to an incident wave.

Thus, the reduction of the reflection near the opening portion means that acoustic energy is permeated well and discharged to an exterior area.

Figure 18:
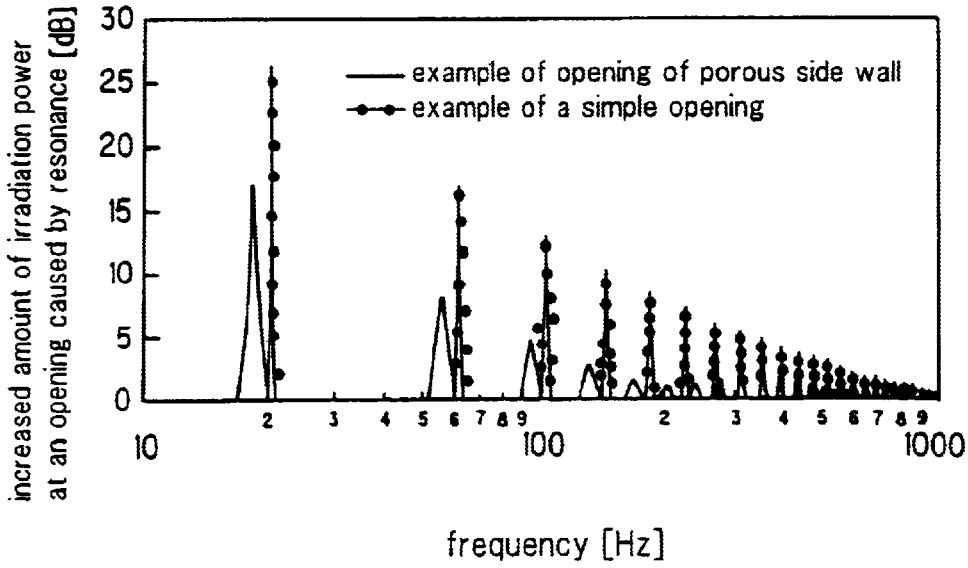
FIG. 18 is a graph showing an increasing ratio of an irradiation power at the opening portion caused by a resonance.

FIG. 18 shows a result of a calculation of energy remaining in the interior area.

As shown in FIG. 18, upon comparing a porous side wall near the opening portion indicated as a heavy line and a simple opening portion indicated as a light line, it is found that the peak amount caused by the resonance cab be reduced in the fifth embodiment The ratio of the opening degree is preferably equal to or less than 20%.

Embodiment 6

Figure 12:
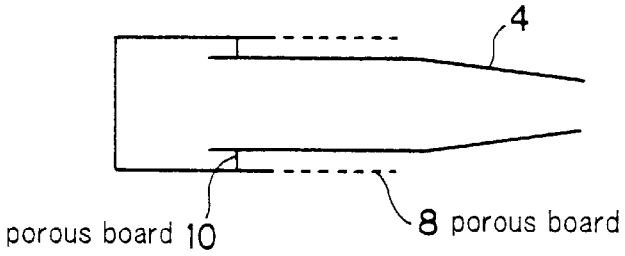
FIG. 12 shows a general view of a gas turbine combustion device of the sixth embodiment according to the present invention.

FIG. 12 shows a sixth embodiment of a gas turbine combustion device according to the present invention.

In the sixth embodiment, a porous board 10 is provided at a position perpendicular to a flowing direction, instead of the sintered metal mesh in the fifth embodiment.

By providing the porous board 10 at the position perpendicular to the flowing direction, a sufficient resistance value can be obtained even if the resistance value of the porous board 8 is insufficient.

In the sixth embodiment, an acoustic reflective ratio near the opening portion can be reduced and the resonance of the combustion device can be reduced by controlling the impedance of the side wall similar to those of the fifth embodiment, and a sufficient resistance value can be obtained by the porous board 10.

Embodiment 7

Figure 13:
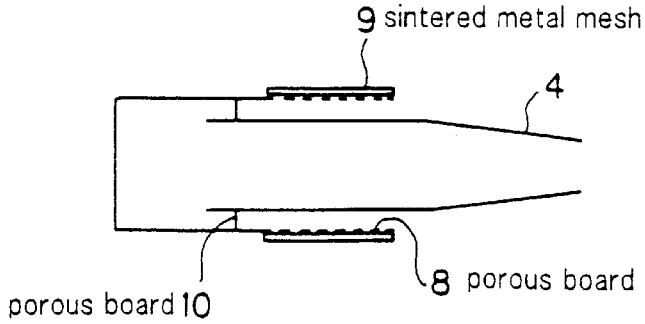
FIG. 13 shows a general view of a gas turbine combustion device of the seventh embodiment according to the present invention.

FIG. 13 shows a seventh embodiment of a gas turbine combustion device according to the present invention.

The seventh embodiment relates to a type combined with the fifth and sixth embodiments.

A side wall near the opening portion at an upstream side of the combustion device 4 is a porous board 8 and a sintered metal mesh 9 is added at an outer side. In addition, a porous board 10 is provided at a position perpendicular to a flowing direction.

The sintered metal mesh 9 and the porous board 10 are provided in order to increase the resistance value in the case that a resistance value of a single porous board is insufficient.

In the seventh embodiment, although the sintered metal mesh 9 is described, a ceramic piece, porous board and so on may be utilized.

In the seventh embodiment, the acoustic reflective ratio near the opening portion and the resonance of the combustion device can be reduced by controlling the impedance of the side wall similar to the fifth and sixth embodiments so that a sufficient resistance value can be obtained by the sintered metal mesh 9 and the porous board 10.

Embodiment 8

Figure 14A:
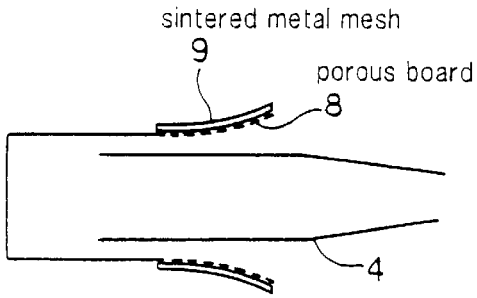
FIGS. 14*a* and 14*b* show a general view of a gas turbine combustion device of the eighth embodiment according to the present invention.
Figure 14B:
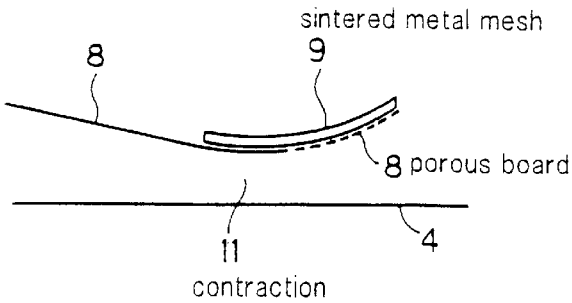

FIG. 14 shows an eighth embodiment of a gas turbine device according to the present invention.

In the eighth embodiment, a porous board 8 is provided near an opening portion at the upstream side of a combustion device 4 and a sintered metal mesh 9 is added at an outer side of the porous board 8. Further, a contraction 11 is provided in a flow path near the opening portion so as to reduce acoustic coupling between the combustion device 4 and a vehicle chamber 1.

If the resistance value of one porous board is insufficient, the sintered metal mesh 9 is provided so as to increase the resistance value.

In the eighth embodiment, although the metal mesh 9 is utilized, a ceramic piece, a porous board and so on may be utilized.

In the eighth embodiment, the acoustic reflective ratio near the opening portion and the resonance in the combustion device can be reduced by controlling the impedance of the side wall so as to have a structure similar to that of the first embodiment. Further, the contraction 11 is provided in the flow path near the opening portion so that the acoustic coupling formed by the vehicle chamber 1 and the combustion device 4 can be reduced.

Embodiment 9

Figure 15:
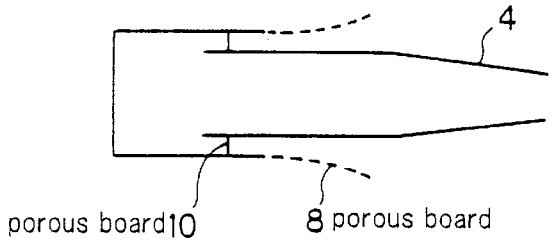
FIG. 15 shows a general view of a gas turbine combustion device of the ninth embodiment according to the present invention.

FIG. 15 shows a ninth embodiment of a gas turbine combustion device according to the present invention.

In the ninth embodiment, a porous board 10 is provided at a position perpendicular to a flowing direction instead of the sintered metal mesh 9 of the eighth embodiment.

By providing the porous board 10 at the position perpendicular to the flowing direction, a sufficient resistance value can be obtained even if a resistance value of the porous board 8 is insufficient.

In the ninth embodiment, the acoustic reflective ratio near the opening portion and the resonance in the combustion device can be reduced by controlling the impedance of the side wall so as to obtain an effect similar to that of the eighth embodiment. In addition, a sufficient resistance value can be obtained by providing the porous board 10.

Embodiment 10

Figure 16:
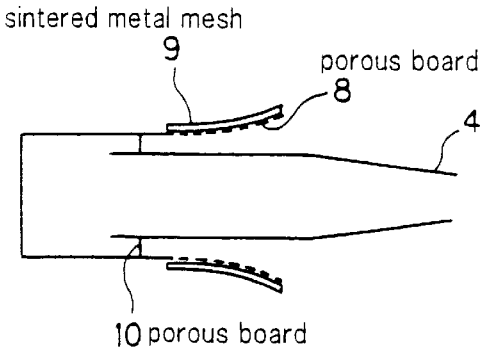
FIG. 16 shows a general view of a gas turbine combustion device of the tenth embodiment according to the present invention.

FIG. 16 shows a tenth embodiment of a gas turbine combustion device according to the present invention.

The tenth embodiment relates to a type combined the eighth embodiment and the ninth embodiment.

The porous board 8 is provided at a side wall near the opening portion, the sintered metal mesh 9 is added at an outer side of the porous board 8 and a contraction 11 is provided in a flow path near the opening portion. Thereby, an acoustic coupling between the combustion device 4 and the vehicle chamber 1 can be reduced.

If a resistance value of a single porous board is insufficient, the sintered metal mesh 9 is provided to increase the resistance value.

Although the sintered metal mesh 9 is described in the tenth embodiment, a ceramic piece, a porous board and so on may be utilized.

In the tenth embodiment, an acoustic reflective ratio near an opening portion and a resonance in a combustion device can be reduced by controlling an impedance of a side wall. A sufficient resistance value can be obtained by providing the porous board. Further, the acoustic coupling formed by the combustion device 4 and the vehicle chamber 1 can be reduced by providing the contraction 11 in the flow path near the opening portion.

Embodiment 11

The eleventh embodiment relates to a type in which a board having a number of narrow slits is provided instead of a porous board on a side wall near the opening portion in the fifth embodiment.

In the eleventh embodiment, the narrow slits provide an effect similar to that of the porous board so that an acoustic reflective ratio near the opening portion and a resonance in a combustion device can be reduced by controlling an impedance of the side wall. Thus, an effect similar to that of the fifth embodiment can be obtained.

Embodiment 12

The twelfth embodiment relates to a type in which a board having a number of narrow slits is provided instead of a porous board at a side wall near the opening portion in the sixth embodiment.

In the twelfth embodiment, the narrow slits provide an effect similar to that of the porous board so that an acoustic reflective ratio at the opening portion and a resonance in a combustion device can be reduced by controlling an impedance of the side wall. Thus, an effect similar to that of the sixth embodiment can be obtained.

Embodiment 13

The thirteenth embodiment relates to a type in which a board having a number of narrow slits is provided instead of a porous board at a side wall near the opening portion in the seventh embodiment.

In the thirteenth embodiment, the narrow slits provide an effect similar to that of the porous board so that an acoustic reflective ratio at the opening portion and a resonance in a combustion device can be reduced by controlling an impedance of the side wall. Thus, an effect similar to that of the seventh embodiment can be obtained.

Embodiment 14

The fourteenth embodiment relates to a type in which a board having a number of narrow slits is provided instead of a porous board at a side wall near the opening portion in the eighth embodiment.

In the fourteenth embodiment, the narrow slits provide an effect similar to that of the porous board so that an acoustic reflective ratio at the opening portion and a resonance in a combustion device can be reduced by controlling an impedance of the side wall. Thus, an effect similar to that of the eighth embodiment can be obtained.

Embodiment 15

The fifteenth embodiment relates to a type in which a board having a number of narrow slits is provided instead of a porous board near a side wall of the opening portion in the ninth embodiment.

In the fifteenth embodiment, the narrow slits provide an effect similar to that of the porous board so that an acoustic reflective ratio at the opening portion and a resonance in a combustion device can be reduced by controlling an impedance of the side wall. Thus, an effect similar to that of the ninth embodiment can be obtained.

Embodiment 16

The sixteenth embodiment relates to a type in which a board having a number of narrow slits is provided instead of a porous board at a side wall near the opening portion in the tenth embodiment.

In the sixteenth embodiment, the narrow slits provide an effect similar to that of the porous board so that an acoustic reflective ratio at the opening portion and a resonance in a combustion device can be reduced by controlling an impedance of the side wall. Thus, an effect similar to that of the tenth embodiment can be obtained.

To address the above objects, a gas turbine combustion device according to the first aspect of the present invention comprises a plurality of combustion devices in a vehicle chamber, each combustion device having an inner cylinder and a tail cylinder and an acoustic sleeve between the respective inner cylinder and a corresponding outer cylinder in the vehicle body so as to reduce a coupling effect with the vehicle body so that a number of acoustic modes can be reduced and combustion oscillation can be reduced. If an element experiment is operated in a sector of one combustion device, the actual combustion oscillation can be accurately reproduced. As the result, combustion oscillations can be prevented and the reliability of the combustion device can be improved.

A gas turbine combustion device according to the third aspect of the present invention comprises a plurality of combustion devices in a vehicle chamber, each combustion device having an inner cylinder and a tail cylinder and a porous side wall near an opening portion at an upstream side of the combustion so as to reduce a reflective ratio at the opening portion and an increase in fluctuation pressure and self-oscillation caused by resonance can be reduced by controlling an acoustic characteristic at an opening portion as seen from the interior side of the combustion device at an intake port.

A gas turbine combustion device according to the fourth aspect of the present invention further comprises a sintered metal mesh, a ceramic piece, a porous board and so on at an outer side surface of the porous board according to the third aspect of the present invention, so that a reflective ratio at the opening portion can be reduced and fluctuation pressure increasing and self-oscillation caused by resonance can be reduced by controlling an acoustic characteristic at an opening portion as seen from the interior side of the combustion device at an intake port. In addition, a resistance value can be increased by providing the sintered metal mesh and so on.

A gas turbine combustion device according to the fifth aspect of the present invention further comprises a contraction for controlling a flowing path near the opening portion according to the third aspect of the present invention, so that a reflective ratio at the opening portion can be reduced and fluctuation pressure increases and self-oscillation caused by resonance can be reduced by controlling an acoustic characteristic at an opening portion as seen from the interior side of the combustion device at an intake port similar to an effect according to the third aspect of the present invention. In addition, an acoustic coupling effect between the combustion device and the vehicle chamber can be reduced by providing the contraction.

A gas turbine combustion device according to the sixth aspect of the present invention further comprises a porous board located at a position perpendicular to a flowing direction at an upstream side of the combustion device so that a reflective ratio at the opening portion can be reduced and fluctuation pressure increases and self-oscillation caused by resonance can be reduced by controlling an acoustic characteristic at an opening portion as seen from the interior side of the combustion device at an intake port. In addition, a resistance value can be increased by providing a porous board.

A gas turbine combustion device according to the seventh aspect of the present invention further comprises a board having narrow slits instead of a porous board at a side wall near the opening portion at an upstream side of the combustion device according to the third, fourth, fifth and sixth aspects of the present invention, so that a reflective ratio at the opening portion can be reduced and fluctuation pressure increases and self-oscillation caused by resonance can be reduced by controlling an acoustic characteristic at an opening portion as seen from the interior side of the combustion device at an intake port, similar to an effect of the third, fourth and fifth aspects of the present invention. In addition, a resistance value can be increased by providing a porous board.

The present invention is, of course, in no way restricted to the specific disclosure of the specification and drawings, but also encompasses any modifications within the scope of the appended claims.

What is claimed is:

1. A gas turbine combustion device comprising a plurality of combustion devices provided in a combustor housing, each of said combustion devices having an inner cylinder and a tail cylinder, further comprising a porous structure on a radially outward side wall relative to said cylinder, that is located near an opening end directing the air flow upstream between said wall and said cylinder of said combustion device.

2. A gas turbine combustion device as claimed in claim 1 further comprising at least one of a sintered metal mesh, a ceramic piece and a porous board at an outer side of said porous structure.

3. A gas turbine combustion device as claimed in claim 1, further comprising a contraction in a flow path near said opening portion.

4. A gas turbine combustion device as claimed in claim 1 further comprising a porous board located at a position perpendicular to a combustion flow at an upstream side of said combustion device.

5. A gas turbine combustion device as claimed in claim 1, further comprising a board having a narrow slit near an upstream opening portion of said combustion device.

6. The gas turbine combustion device of claim 3, wherein the porous structure is arranged so as to reduce an acoustic coupling between said combustor housing and said combustion device.

* * * * *